US009127466B2

(12) United States Patent
Hinkle

(10) Patent No.: US 9,127,466 B2
(45) Date of Patent: Sep. 8, 2015

(54) INTEGRATED DECKING MEMBER FASTENING TRACK SYSTEM INSTALLATION METHOD AND TOOL

(71) Applicant: Donald G. Hinkle, Merlin, OR (US)

(72) Inventor: Donald G. Hinkle, Merlin, OR (US)

( * ) Notice: Subject to any disclaimer, the term of this patent is extended or adjusted under 35 U.S.C. 154(b) by 0 days.

(21) Appl. No.: 14/477,864

(22) Filed: Sep. 5, 2014

(65) Prior Publication Data

US 2015/0040514 A1 Feb. 12, 2015

Related U.S. Application Data

(63) Continuation of application No. PCT/US2013/028859, filed on Mar. 4, 2013.

(51) Int. Cl.

| | |
|---|---|
| ***E04B 2/30*** | (2006.01) |
| ***E04F 15/02*** | (2006.01) |
| ***E04F 21/20*** | (2006.01) |
| ***E04F 15/04*** | (2006.01) |

(52) U.S. Cl.

CPC ..... *E04F 15/02044* (2013.01); *E04F 15/02038* (2013.01); *E04F 15/02133* (2013.01); *E04F 15/04* (2013.01); *E04F 21/20* (2013.01)

(58) Field of Classification Search

CPC ..... E04B 2002/7475; E04D 3/3605; E04F 15/04; E04F 15/02044; E04F 15/20; E04F 15/02038; E04F 15/02133

USPC ..... 52/172, 483.1, 480, 489.1, 489.2, 52/650.3, 745.13, 765; 411/458

See application file for complete search history.

(56) References Cited

U.S. PATENT DOCUMENTS

| | | | | |
|---|---|---|---|---|
| 847,272 | A | 3/1907 | Ayers | |
| 5,842,319 | A | 12/1998 | Ravetto | |
| 7,571,580 | B2 * | 8/2009 | Miller | 52/650.3 |
| 7,874,113 | B2 * | 1/2011 | Eberle, III | 52/403.1 |
| 8,146,303 | B2 * | 4/2012 | Gibson et al. | 52/177 |
| 8,544,229 | B2 * | 10/2013 | Kilgore et al. | 52/489.2 |
| 8,672,600 | B2 * | 3/2014 | Reznar et al. | 411/457 |
| 2005/0257473 | A1 * | 11/2005 | Shaw et al. | 52/480 |
| 2010/0146900 | A1 * | 6/2010 | Holland | 52/650.3 |
| 2010/0313714 | A1 | 12/2010 | Smith | |
| 2011/0067335 | A1 | 3/2011 | Gibson et al. | |

OTHER PUBLICATIONS

International Search Report and Written Opinion issued on May 10, 2013, in connection with International Application No. PCT/US2013/028859.

* cited by examiner

*Primary Examiner* — Jeanette E Chapman
*Assistant Examiner* — James Buckle, Jr.
(74) *Attorney, Agent, or Firm* — Corridor Law Group, P.C.

(57) ABSTRACT

An installation method and tool facilitate the installation of decking members onto an elongated fastening track in an integrated fastening track systems. The installation tool comprises a base having a distal portion and a proximal portion. Imparting a striking force to the rear face of the base distal portion urges the front surface of the base proximal portion laterally into contact with fastening tangs integral with and extending upwardly from the fastening track, thereby engaging the fastening tangs to secure a decking member with longitudinal side edge slots to the fastening track.

20 Claims, 7 Drawing Sheets

FIG. 3
(Prior Art)
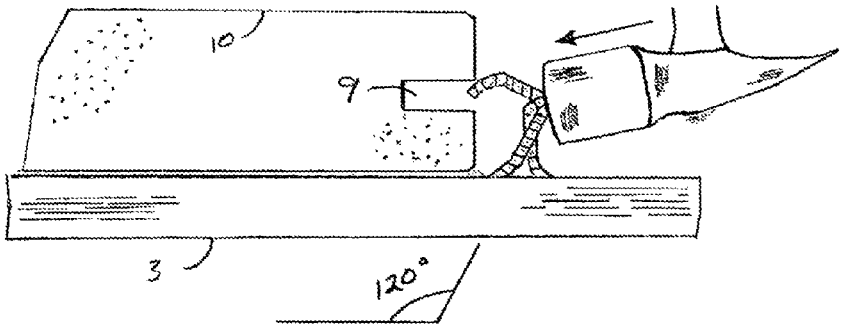
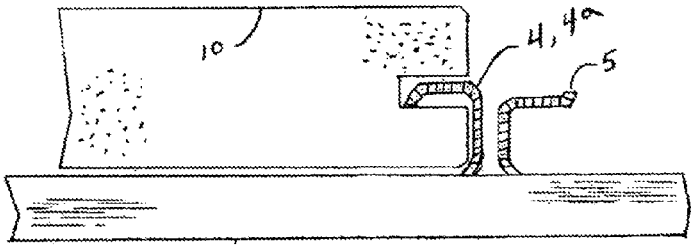
FIG. 4
(Prior Art)

INTEGRATED DECKING MEMBER FASTENING TRACK SYSTEM INSTALLATION METHOD AND TOOL

CROSS-REFERENCE TO RELATED APPLICATIONS

This application is a continuation of International Application No. PCT/US2013/028859, having an international filing date of Mar. 4, 2013, entitled "Integrated Decking Member Fastening Track System Installation Method And Tool". The '859 international application claimed priority benefits, in turn, from U.S. Provisional Patent Application Ser. No. 61/634,757 filed on Mar. 5, 2012, entitled "Integrated Fastening Systems Installation Tool". The '859 international application is hereby incorporated by reference herein in its entirety.

This application is also related to U.S. Non-Provisional patent application Ser. No. 12/807,897 filed on Sep. 16, 2010, now U.S. Pat. No. 8,146,303 issued on Apr. 3, 2012, entitled "Integrated Decking Member Fastening Track". The '897 application is hereby incorporated by reference herein in its entirety.

FIELD OF THE INVENTION

The present invention relates to the construction of decks and other supported flooring structures formed by an arrangement in parallel of elongated decking or flooring boards.

BACKGROUND OF THE INVENTION

The decking industry is increasingly utilizing composite materials as the deck material of choice. Reasons for this trend include durability advantages and an increasingly environmentally conscious consumer base. As a deck material, wood is both limited in its durability and longevity, as well as inconsistent in quality. Composite decking materials are typically manufactured using a mixture of plastic and wood fiber. Many consumers are also choosing such composite building materials as a means of "building green", that is, choosing more environmentally responsible and resource-efficient practices in the design, construction, operation, maintenance, renovation and demolition of homes and related structures. This practice allows consumers to expand and complement the classical building design concerns of economy, utility, durability and comfort.

Unlike conventional wooden lumber-based deck surfaces that are nailed or screwed to a joist or other supporting member, deck boards formed from composite materials are typically secured with hidden fastening systems employing individual clips. The use hidden fastening systems employing individual clips provides a more "finished" appearance because the surfaces of the installed composite deck boards display little or no evidence of having been nailed or screwed down. Despite this cosmetic advantage, however, hidden fastening systems employing individual clips have practical limitations (See, for example, U.S. Pat. No. 6,416,269 and U.S. Patent Application Publication No. US2007/0289232A1).

Hidden fastening systems employing individual clips have limitations, including: (1) insufficient fastening strength resulting in uneven gaps and loose deck boards, (2) handling of many individual clips resulting in increased time to install deck boards, and (3) repetitive hand motions using drills and screws required for installing individual clip-based systems resulting in increased fatigue on the installers' hands and lower back.

The present installation method and tool facilitate the installation of decking members onto an elongated fastening track in an integrated fastening track system of the type disclosed in U.S. Pat. No. 8,146,303. As shown in FIG. 1 (Prior Art) hereto, which is also FIG. 1 of the '303 patent, fastening track 3 connects successive slotted decking members 10 to an underlying joist or other supporting member 2. Fastening track 3 is attached atop laterally adjacent supporting member 2, which is fastened onto ledger boards running perpendicular to supporting member 2. The leading edge of track 3 is aligned on supporting members 2 such that decking members attached to track 3 will remain parallel throughout the deck installation. The top panel of track 3 contains multiple openings 7 allowing for passage of elongated connectors to optionally attach track 3 to supporting member 2 using screws and/or nails.

"Decking member" refers to an elongated board, plank or other longitudinally-extending construction member having generally flat bottom and top surfaces, and manufactured in convenient widths, such as those suitable for use as a deck surface, regardless of materials from which the members are made or their method of manufacture. A decking member can be made from wood, polymer, laminate, composite, and other similarly suitable materials.

FIG. 2 (Prior Art) hereto shows a cross-sectional view of fastening track 3 of the '303 patent connected to its underlying support member 2. As shown, fastening track 3 has three planar surfaces, including a top panel and two side panels arranged such that the panels form a downwardly-facing channel. A series of receiving tangs, one of which is shown in FIG. 2 (Prior Art) hereto as receiving tang 5, are formed integrally with and extend generally upwardly from the top panel of track 3. A series of pairs of fastening tangs, one pair of which is shown as fastening tangs 4, 4*a*, adjoin receiving tang 5 on each side thereof.

FIG. 2 (Prior Art) hereto also shows lower tangs 11 formed integrally with and extending generally inwardly from fastening track 3 towards the downwardly-facing channel from both side panels. As shown, Point or edge 6 of each lower tang 11 digs into supporting member 2. In circumstances in which fastening track 3 would be adequately secured to supporting member 2 by the natural compression of the side panels against supporting member 2, lower tangs 11 could be omitted.

As shown in FIGS. 3 and 4 (Prior Art) hereto, each decking member 10 to be attached to fastening track 3 has a slot 9 formed along each of its longitudinal side edges. After fastening track 3 is pressed into position atop a supporting member 2, a decking member 10 can be inserted into track 3 by lowering decking member 10 onto receiving tang 5 such that receiving tang 5 slips into the horizontal slot 9 along the opposite longitudinal side edge (not shown in FIGS. 3 and 4 (Prior Art) hereto) of decking member 10. Decking member 10 is then allowed to lay flat, abutting or closely adjacent to fastening tangs 4, 4*a* on opposite sides of receiving tang 5. Once in this position, fastening tangs 4, 4*a* align with decking member longitudinal side edge slot 9. Fastening tangs 4, 4*a* are shown in FIG. 3 (Prior Art) hereto in an "open" position in which each upwardly-extending leg of fastening tangs 4, 4*a* lies open at an approximate 120-degree angle. Upon alignment with slot 9, fastening tangs 4, 4*a* are then pressed into the "closed" position into slot 9, as shown in FIG. 4 (Prior Art). When fastening tangs 4, 4*a* are engaged and in closed position with respect to slot 9, the upwardly-extending legs of tangs 4, 4*a* stand in an approximate vertical position. When closed, fastening tangs 4, 4*a* penetrate the lower surface of the longitudinal slot 9. Once fastening tangs 4, 4*a* are securely engaged in decking member 10, the process of installing the next decking member can continue.

SUMMARY OF THE INVENTION

Shortcomings and limitations of existing decking member fastening system installation methods are overcome by an improved method of installing a decking member in an integrated fastening track system. The decking member has a slot formed along each of its longitudinal side edges. The method comprises:

(a) attaching an elongated track to an underlying support member, the track comprising:
  (1) a top panel;
  (2) a plurality of receiving tangs integral with and extending generally upwardly from the track top panel and spaced apart a distance corresponding to the width of the decking member, each of the receiving tangs capable of engaging one of the decking member longitudinal side edge slots;
  (3) a plurality of spaced-apart pairs of fastening tangs integral with and extending generally upwardly from the track top panel, each of the pairs of fastening tangs adjoining a receiving tang and oriented at an open angle prior to engaging the other of the decking longitudinal side edge slots;

(b) orienting the decking member such that the one of the longitudinal side edge slots engages a receiving tang and the other of the longitudinal side edge slots is aligned with a pair of fastening tangs adjoining a spaced-apart receiving tang;

(c) positioning an installation tool on the track top panel immediately adjacent to and on the side of the fastening tangs facing away from the decking member, the installation tool comprising a base having a distal portion and a proximal portion, the base distal portion comprising:
  (1) a bottom face having a pair of oppositely disposed side rails projecting downwardly such that a channel is formed therebetween and configured to slidably straddle the track top panel;
  (2) a generally planar top face having a hole formed therein for receiving and securing a manipulating rod or handle therein;
  (3) a generally planar rear face interconnecting the top and bottom faces of the base distal portion, the rear face angled such that the rear face bottom edge extends distally farther than the rear face top edge, whereby the rear face presents a surface for conveniently receiving an impact force from a hammering device;
  (4) a front face;
  the base proximal portion extending laterally from a bottom region of the front face, the base proximal portion comprising:
  (5) a bottom face having a pair of oppositely disposed side rails projecting downwardly such that a channel is formed therebetween and configured to slidably straddle the track top panel;
  (6) a generally planar top face disposed at a distance from the base proximal portion bottom face less than the distance of the base distal portion top face from the base distal portion bottom face;
  (7) a front surface alignable with the fastening tangs and having a gap formed therein with a width such that the adjoining receiving tang is receivable within the gap and contact between the base proximal portion and the receiving tang is avoided;

(d) imparting a striking force to the rear face, whereby the front surface is urged laterally into contact with the fastening tangs, thereby engaging the fastening tang lateral arms within the other of the decking member longitudinal side edge slots to secure the decking member to the track.

In a preferred embodiment, each of the pairs of fastening tangs has a receiving tang interposed therebetween and the base proximal portion front surface comprises a pair of front surface portions alignable with the pair of fastening tangs and having the gap formed therebetween.

In a preferred embodiment, the base distal portion top face hole is threaded and the manipulating rod has corresponding threads formed on an end thereof, the manipulating rod threaded end receivable and securable within the base distal portion top face threaded hole.

In a preferred embodiment, the base distal portion rear face has a hole formed therein for receiving and securing a striker insert therein. The base distal portion rear face hole is preferably threaded and the striker insert preferably comprises a shaft extending therefrom having corresponding threads formed thereon. The striker insert shaft is receivable and securable within the base distal portion rear face threaded hole. The striker insert can take the form of a resilient pad capable of cushioning the striking force when imparted by a manually operated hammer. The striker insert can also take the form of a rigid plate capable of absorbing the striker force when imparted by a pneumatically operated hammer.

In a preferred embodiment, the base is milled from a single block of rigid material, such that the base proximal portion is formed integrally with the base distal portion. The base can also be molded from impact resistant thermoplastic material. In the molded embodiment, the front surface has a pair of reinforcement inserts embedded within the front surface, such that the thermoplastic material is protected from direct contact with the fastening tangs.

Shortcomings and limitations of existing decking member fastening system installation tools are overcome by an improved installation tool for installing a decking member to an elongated track in an integrated fastening track system. The decking member has a slot formed along each of its longitudinal side edges. The track is capable of attachment to an underlying support member and comprising (a) a top panel, (b) a plurality of receiving tangs integral with and extending generally upwardly from the track top panel and spaced apart a distance corresponding to the width of the decking member, each of the receiving tangs capable of engaging one of the decking member longitudinal side edge slots, and (c) a plurality of spaced-apart pairs of fastening tangs integral with and extending generally upwardly from the track top panel. Each of the pairs of fastening tangs adjoins a receiving tang and is oriented at an open angle prior to engaging the other of the decking longitudinal side edge slots.

In one embodiment, the improved installation tool comprises a base having a distal portion and a proximal portion. The base distal portion comprises:

(a) a bottom face having a pair of oppositely disposed side rails projecting downwardly such that a channel is formed therebetween and configured to slidably straddle the track top panel;

(b) a generally planar top face having a hole formed therein for receiving and securing a manipulating rod or handle therein;

(c) a generally planar rear face interconnecting the top and bottom faces of the base distal portion, the rear face angled such that the rear face bottom edge extends distally farther than the rear face top edge, whereby the rear face presents a surface for conveniently receiving an impact force from a hammering device;

(d) a front face.

The base proximal portion extends laterally from a bottom region of the front face. The base proximal portion comprises:

(e) a bottom face having a pair of oppositely disposed side rails projecting downwardly such that a channel is formed therebetween and configured to slidably straddle the track top panel;

(f) a generally planar top face disposed at a distance from the base proximal portion bottom face less than the distance of the base distal portion top face from the base distal portion bottom face;

(g) a front surface alignable with the fastening tangs and having a gap formed therein with a width such that the adjoining receiving tang is receivable within the gap and contact between the base proximal portion and the receiving tang is avoided.

In operation, imparting a striking force to the rear face of the improved installation tool urges the front surface laterally into contact with the fastening tang, thereby engaging the fastening tangs within the other of the decking member longitudinal side edge slots to secure the decking member to the track.

In a preferred embodiment, each of the pairs of fastening tangs has a receiving tang interposed therebetween and the base proximal portion front surface comprises a pair of front surface portions alignable with the pair of fastening tangs and having the gap formed therebetween.

In a preferred embodiment, the base distal portion top face hole is threaded and the manipulating rod has corresponding threads formed on an end thereof. The manipulating rod threaded end is receivable and securable within the base distal portion top face threaded hole.

In a preferred embodiment, the installation tool further comprises a striker insert and the base distal portion rear face has a hole formed therein for receiving and securing the striker insert therein. The base distal portion rear face hole is preferably threaded and the striker insert comprises a shaft extending therefrom having corresponding threads formed therefrom. The striker insert shaft is receivable and securable within the base distal portion rear face threaded hole. The striker insert can take the form of a resilient pad capable of cushioning the striking force when imparted by a manually operated hammer. The striker insert can also take the form of a rigid plate capable of absorbing the striker force when imparted by a pneumatically operated hammer.

In a preferred embodiment, the base is milled from a single block of rigid material, such that the base proximal portion is formed integrally with the base distal portion. The base can also be molded from impact resistant thermoplastic material. In the molded embodiment, the front surface has a pair of reinforcement insert embedded within the front surface, such that the thermoplastic material is protected from direct contact with the fastening tangs.

BRIEF DESCRIPTION OF THE DRAWINGS

FIG. 3 (Prior Art) is a side elevation view of an engaged slotted decking member with a fastening tang in open position and a hammer in striking position; this figure corresponds to FIG. 6 of related U.S. Pat. No. 8,146,303.

FIG. 4 (Prior Art) is a side elevation view of an engaged slotted decking member with a fastening tang in closed position and with the leading edge of the tang engaging the slot; this figure corresponds to FIG. 7 of related U.S. Pat. No. 8,146,303.

DETAILED DESCRIPTION OF PREFERRED EMBODIMENT(S)

Turning first to FIGS. 5-9, a milled embodiment of an installation tool 100 facilitates the installation of decking members onto an elongated fastening track in an integrated fastening track system. Installation tool 100 includes a base 110 having a distal portion 120 and a proximal portion 150.

Figure 1:
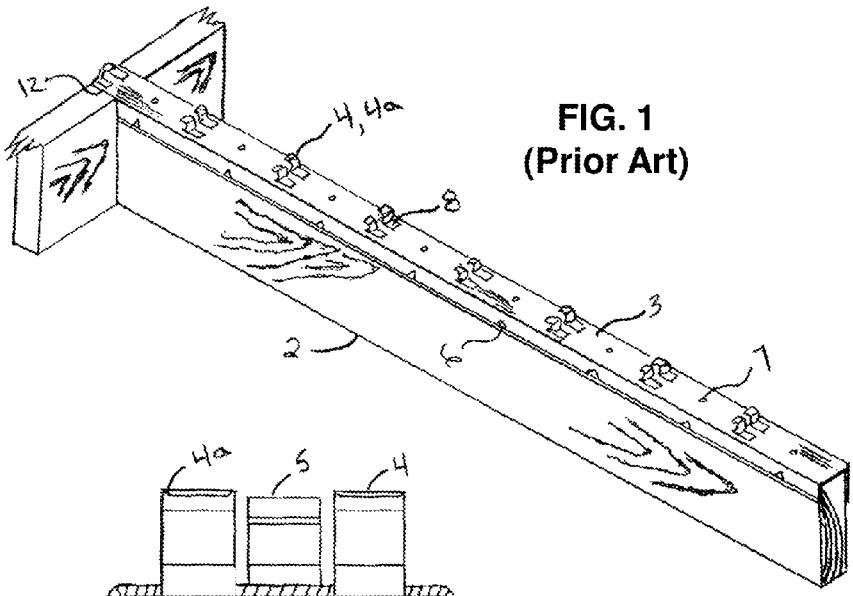
FIG. 1 (Prior Art)
FIG. 1 (Prior Art) is a perspective view of an integrated decking member fastening track system with an elongated track affixed atop a supporting member; this figure corresponds to FIG. 1 of related U.S. Pat. No. 8,146,303.
Figure 2:
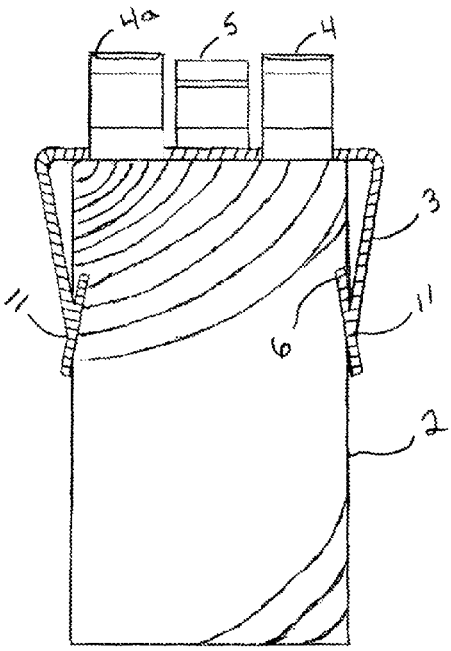
FIG. 2 (Prior Art)
FIG. 2 (Prior Art) is a cross-sectional view of the elongated track of FIG. 1 affixed atop a supporting member; this figure corresponds to FIG. 4 of related U.S. Pat. No. 8,146,303.
Figure 5:
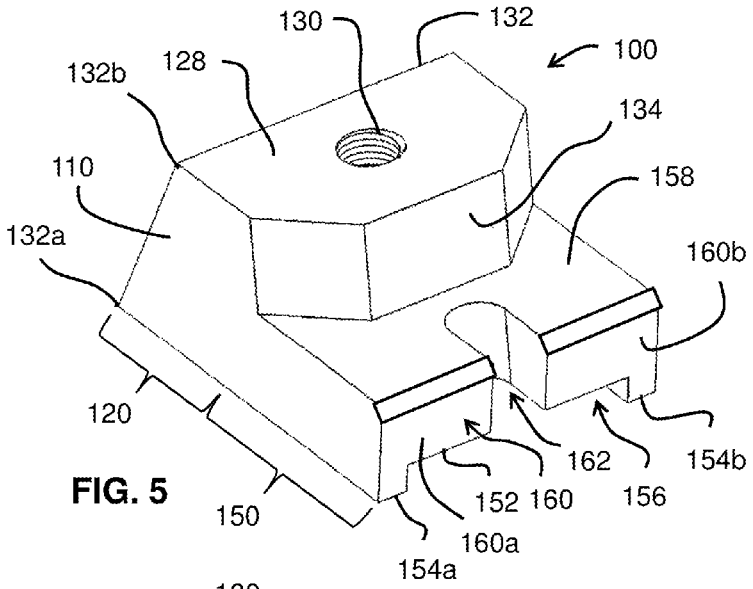
FIG. 5 is a front perspective view of a milled embodiment of an installation tool for an integrated decking member fastening track system.

As best shown in FIG. 5 hereto, base distal portion 120 includes a bottom face 122 having a pair of oppositely disposed side rails 124*a*, 124*b* projecting downwardly such that a channel 126 is formed therebetween. Bottom face 122 is configured to slidably straddle a fastening track top panel, such as the fastening track illustrated in FIGS. 1-4 (Prior Art) hereto.

Figure 8:
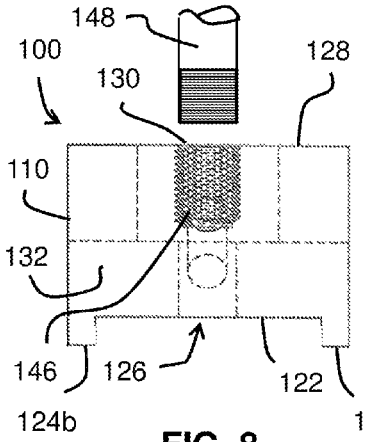
FIG. 8 is a rear elevation of the milled embodiment of the installation tool shown in FIGS. 5-7.
Figure 9:
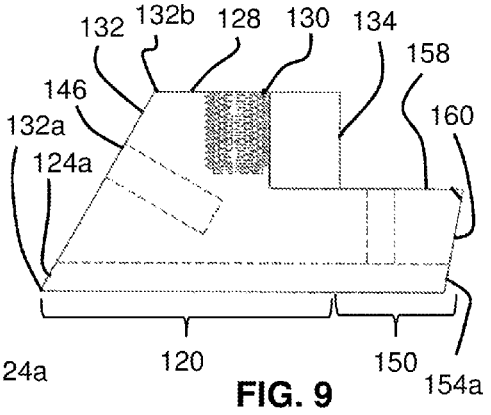
FIG. 9 is a side elevation of the milled embodiment of the installation tool shown in FIGS. 5-8.
Figure 10:
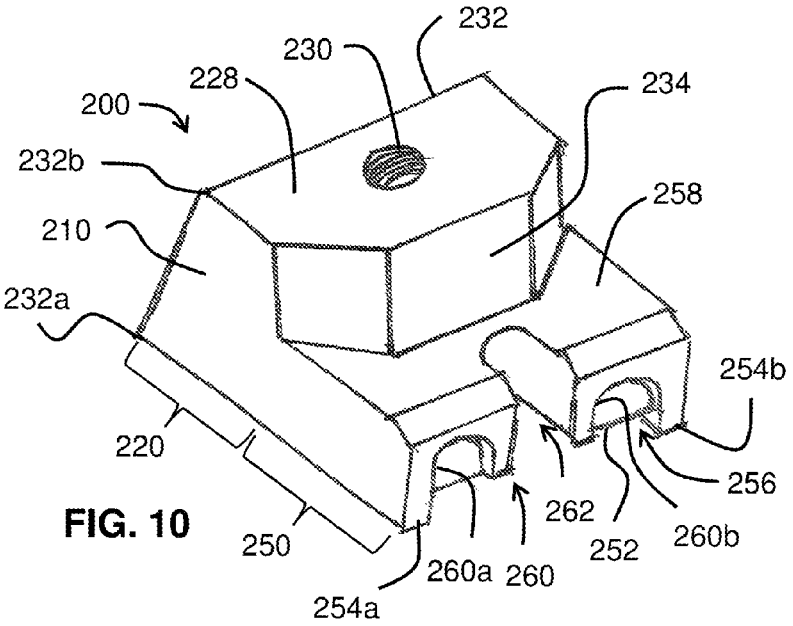
FIG. 10 is a front perspective view of a molded embodiment of an installation tool for an integrated decking member fastening track system.
Figure 11:
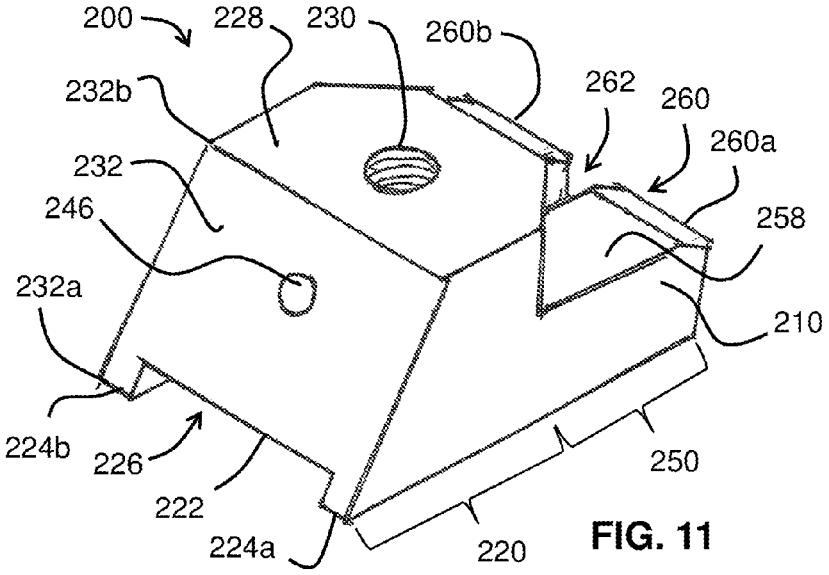
FIG. 11 is a rear perspective view of the molded embodiment of the installation tool shown in FIG. 10.
Figure 12:
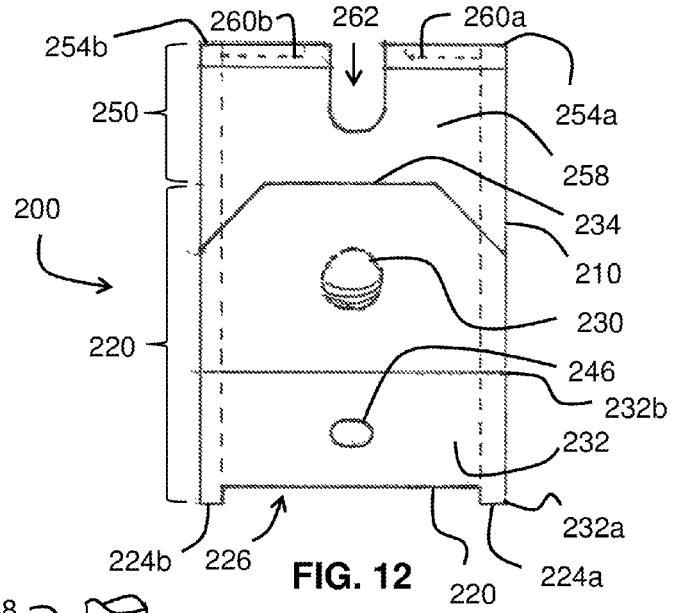
FIG. 12 is a top view of the molded embodiment of the installation tool shown in FIGS. 10 and 11.
Figure 13:
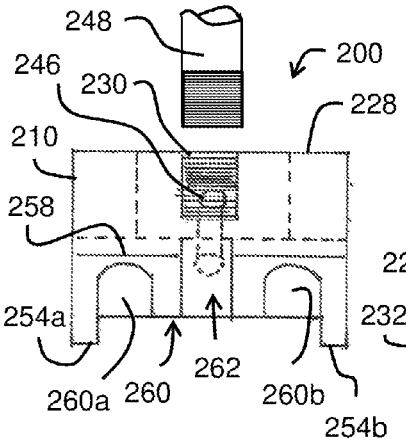
FIG. 13 a front elevation of the molded embodiment of the installation tool shown in FIGS. 10-12.
Figure 14:
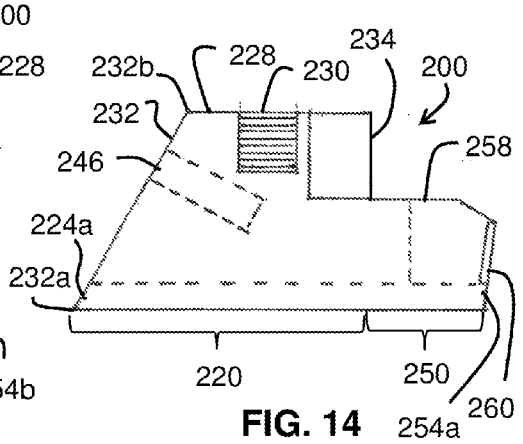
FIG. 14 is a side elevation of the molded embodiment of the installation tool shown in FIGS. 10-13.

As further shown in FIGS. 5-9 hereto, base distal portion 122 has a generally planar top face 128 with a hole 130 formed therein for receiving and securing a manipulating rod 148 therein. An end portion of a manipulating rod 148 is shown in FIG. 8 hereto. As best shown in FIG. 5 hereto, base distal portion 120 also includes a front face 134.

Figure 6:
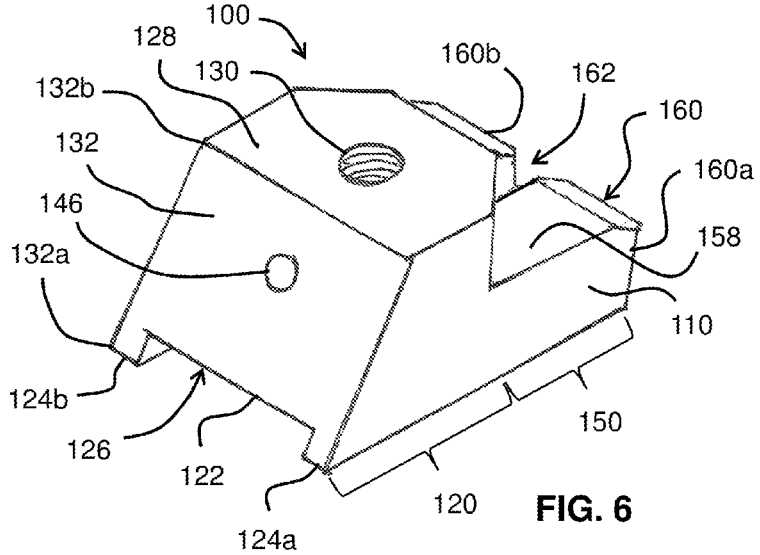
FIG. 6 is a rear perspective view of the milled embodiment of the installation tool shown in FIG. 5.
Figure 7:
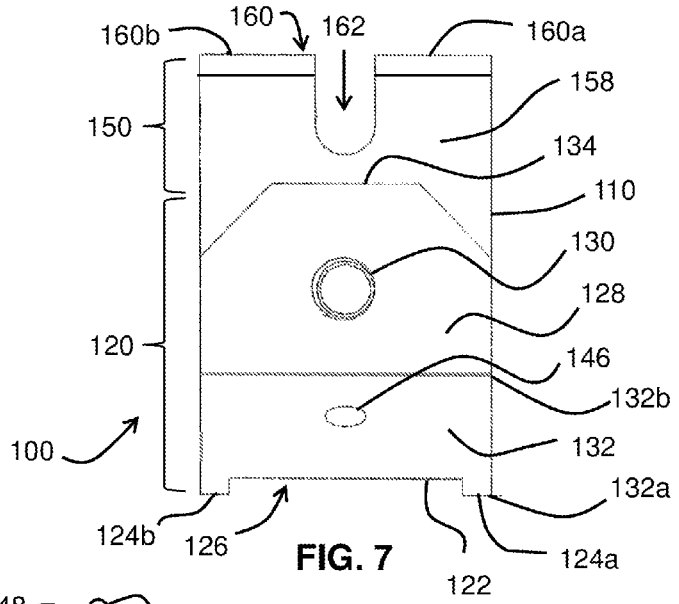
FIG. 7 is a top view of the milled embodiment of the installation tool shown in FIGS. 5 and 6.

As best shown in FIG. 6 hereto, a generally planar rear face 132 interconnects top face 128 and bottom face 122. Rear face 132 is angled such that rear face bottom edge 132*a* extends distally farther than rear face top edge 132*b*. As shown, rear face 132 presents a surface for conveniently receiving an impact force from a hammering device, such as the manually operated hammer shown in FIG. 3 (Prior Art) hereto.

As best shown in FIG. 5 hereto, base proximal portion 150 extends laterally from a bottom region of front face 134. Base proximal portion 150 includes a bottom face 152 having a pair of oppositely disposed side rails 154*a*, 154*b* projecting downwardly such that a channel 156 is formed therebetween. Bottom face 152 is configured to slidably straddle the track top panel, such as the fastening track illustrated in FIGS. 1-4 (Prior Art) hereto.

As further shown in FIGS. 5-9 hereto, base distal portion 150 has a generally planar top face 158 disposed at a distance from base proximal portion bottom face 152 less than the distance of base distal portion top face 128 from base distal portion bottom face 122.

As best shown in FIG. 5 hereto, base proximal portion 150 has a front surface 160 alignable with the fastening tangs extending upwardly from the fastening track top panel. Front surface 160 has a gap 162 formed therein with a width such that the adjoining receiving tang is receivable within gap 162 and contact between base proximal portion 150 and the adjoining receiving tang is avoided.

In operation, imparting a striking force to rear face 132 urges front surface 160 laterally into contact with the fastening tangs, thereby engaging the fastening tangs within the slot in the longitudinal side edge of the adjacent decking member. Once engaged, and as shown in FIGS. 3 and 4 (Prior Art) hereto, the fastening tangs firmly secure decking member 2 to fastening track 3.

When, as shown in FIGS. 1-4, the fastening tangs include a plurality of spaced-apart pairs of fastening tangs 4, 4*a*, each of the pairs of fastening tangs 4, 4*a* has a receiving tang 5 interposed therebetween. In such a configuration, front surface 160 includes a pair of front surface portions 160*a*, 160*b*, which are alignable with an adjacent pair of fastening tangs. In that configuration, gap 162 is formed between front surface portions 160*a*, 160*b*.

FIGS. 5-9 and the foregoing description are directed to a milled embodiment in which base 110 is milled from a single block of rigid material. In such a milled embodiment, base proximal portion 150 is formed integrally with base distal portion 120.

In the molded embodiment of installation tool 200 shown in FIGS. 10-15, base 210 is molded from impact resistant thermoplastic material. In the drawings for this molded embodiment, the last two digits of the numbered components in the 200 series are identical to those shown in FIGS. 5-9, with the exception of the front surface, which contacts the fastening tangs when a striking force is imparted to rear face 232.

As shown in FIGS. 10-15, front surface 260 has recessed portions 260*a*, 260*b* into which reinforcement inserts (not shown) can be embedded or positioned. Gap 262, which corresponds to gap 162 in installation tool 100, is formed between front surface portions 260*a*, 260*b*. The embedded reinforcement inserts protect the thermoplastic material from direct contact with the fastening tangs.

As shown in FIGS. 6-9 for the milled embodiment (FIGS. 11-14 for the molded embodiment), base distal portion rear face 132 has a hole 146 formed therein for receiving and securing a striker insert. Where the rear face hole 146 is threaded, and the striker insert has a shaft extending therefrom with corresponding threads, the striker insert shaft is receivable and securable within rear face threaded hole 146.

Figure 15:
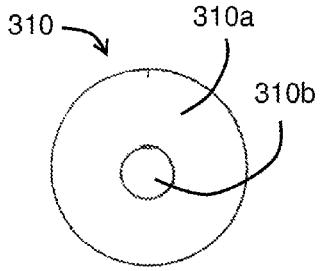
FIG. 15 is a rear elevation view of a resilient striker pad insert for use in applying force from a manually operated hammer to the installation tool in order to orient fastening tangs of a fastening track system in a closed position within a slotted decking member.
Figure 16:
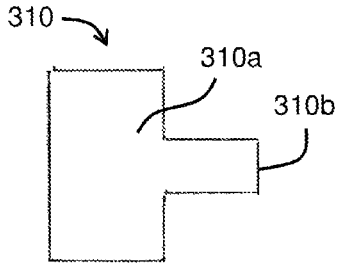
FIG. 16 is a side elevation view of the resilient striker pad insert shown in FIG. 15.
Figure 17:
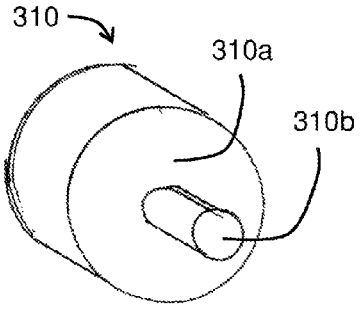
FIG. 17 is a perspective view of the resilient striker pad insert shown in FIGS. 15 and 16.

FIGS. 15-17 illustrate a resilient striker pad insert 310 for use in applying force from a manually operated hammer to the installation tool in order to orient fastening tangs of a fastening track system in a closed position within a slotted decking member. Resilient striker pad insert 310 includes resilient striker pad 310*a* and insertable shaft 310*b*. Resilient materials suitable for striker pad 310 include impact resistant thermoplastic, thermoset and rubber materials, such that a striker pad insert formed of such a resilient material would be capable of cushioning the striking force imparted by a manually operated hammer, for example.

Figure 18:
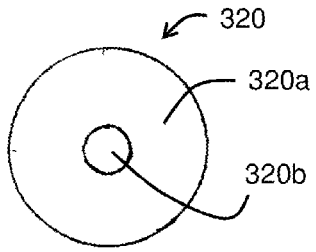
FIG. 18 is a rear elevation view of a rigid striker plate insert for use in applying force from a power-assisted hammer to the installation tool in order to orient fastening tangs of a fastening track system in a closed position within a slotted decking member.
Figure 19:
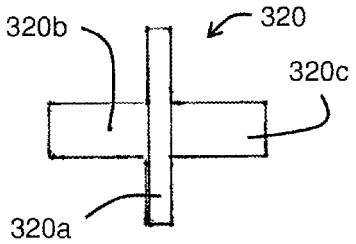
FIG. 19 is a side elevation view of the rigid striker plate insert shown in FIG. 18.
Figure 20:
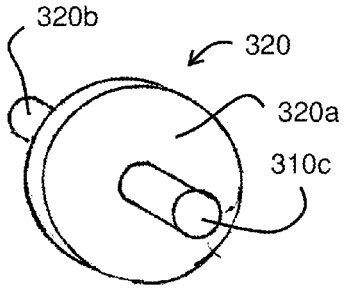
FIG. 20 is a perspective view of the rigid striker plate insert shown in FIGS. 18 and 19.

FIGS. 18-20 illustrate a rigid striker plate insert 320 for use in applying force from a pneumatic hammer to the installation tool in order to orient fastening tangs of a fastening track system in a closed position within a slotted decking member. Rigid striker plate insert 320 includes rigid striker plate 320*a*, integral insertable shaft 320*b*, and integral mounting shaft 320*c*. Mounting shaft 320*c* is configured in accordance with the equipment being used to impart striking force to striker plate insert 320. In the typical case, that equipment would be a pneumatic hammer. Rigid materials suitable for striker plate insert 320 include hardened metals such as steel and high impact composite materials such as carbon fiber-reinforced and glass fiber-reinforced polymeric materials, such that a striker plate insert formed of such a rigid material would be capable of sustaining and protecting the installation tool from the striking force imparted by a pneumatic, hydraulic or other power-assisted hammer.

While particular elements, embodiments and applications of the present invention have been shown and described, it will be understood that the present invention is not limited thereto, since modifications can be made by those skilled in the art without departing from the scope of the present disclosure, particularly in light of the foregoing teachings.

What is claimed is:

1. A method of installing a decking member in an integrated fastening track system, the decking member having a slot formed along each of its longitudinal side edges, the method comprising:

(a) attaching an elongated track to an underlying support member, the track comprising:

(1) a top panel;

(2) a plurality of receiving tangs integral with and extending generally upwardly from said track top panel and spaced apart a distance corresponding to the width of said decking member, each of said receiving tangs capable of engaging one of said decking member longitudinal side edge slots;

(3) a plurality of spaced-apart pairs of fastening tangs integral with and extending generally upwardly from said track top panel, each of said pairs of fastening tangs adjoining a receiving tang and oriented at an open angle prior to engaging said other of said decking longitudinal side edge slots;

(b) orienting said decking member such that said one of said longitudinal side edge slots engages a receiving tang and the other of said longitudinal side edge slots is aligned with a pair of fastening tangs adjoining a spaced-apart receiving tang;

(c) positioning an installation tool on said track top panel immediately adjacent to and on the side of said fastening tangs facing away from said decking member, said installation tool comprising a base having a distal portion and a proximal portion, said base distal portion comprising:

(1) a bottom face having a pair of oppositely disposed side rails projecting downwardly such that a channel is formed therebetween and configured to slidably straddle said track top panel;

(2) a generally planar top face having a hole formed therein for receiving and securing a manipulating rod therein;

(3) a generally planar rear face interconnecting said top and bottom faces of said base distal portion, said rear face angled such that said rear face bottom edge extends distally farther than said rear face top edge, whereby said rear face presents a surface for conveniently receiving an impact force from a hammering device;

(4) a front face;

said base proximal portion extending laterally from a bottom region of said front face, said base proximal portion comprising:

(5) a bottom face having a pair of oppositely disposed side rails projecting downwardly such that a channel is formed therebetween and configured to slidably straddle said track top panel;

(6) a generally planar top face disposed at a distance from said base proximal portion bottom face less than the distance of said base distal portion top face from said base distal portion bottom face;

(7) a front surface alignable with said fastening tangs and having a gap formed therein with a width such that said adjoining receiving tang is receivable within said gap and contact between said base proximal portion and said receiving tang is avoided;

(d) imparting a striking force to said rear face, whereby said front surface is urged laterally into contact with said fastening tangs, thereby engaging said fastening tang lateral arms within said other of said decking member longitudinal side edge slots to secure said decking member to said track.

2. The method of claim 1, wherein each of said pairs of fastening tangs has a receiving tang interposed therebetween and wherein said base proximal portion front surface comprises a pair of front surface portions alignable with said pair of fastening tangs and having said gap formed therebetween.

3. The method of claim 1, wherein said base distal portion top face hole is threaded and said manipulating rod has corresponding threads formed on an end thereof, said manipulating rod threaded end receivable and securable within said base distal portion top face threaded hole.

4. The method of claim 1, wherein said base distal portion rear face has a hole formed therein for receiving and securing a striker insert therein.

5. The method of claim 4, wherein said base distal portion rear face hole is threaded and said striker insert comprises a shaft extending therefrom having corresponding threads formed thereon, said striker insert shaft receivable and securable within said base distal portion rear face threaded hole.

6. The method of claim 4, wherein said striker insert is a resilient pad capable of cushioning said striking force when imparted by a manually operated hammer.

7. The method of claim 4, wherein said striker insert is a rigid plate capable of absorbing said striker force when imparted by a pneumatically operated hammer.

8. The method of claim 1, wherein said base is milled from a single block of rigid material, whereby said base proximal portion is formed integrally with said base distal portion.

9. The method of claim 1, wherein said base is molded from impact resistant thermoplastic material.

10. The method of claim 9, wherein said front surface has a pair of reinforcement inserts embedded within said front surface, whereby said thermoplastic material is protected from direct contact with said fastening tangs.

11. An installation tool for installing a decking member to an elongated track in an integrated fastening track system, the decking member having a slot formed along each of its longitudinal side edges, the track capable of attachment to an underlying support member and comprising (a) a top panel, (b) a plurality of receiving tangs integral with and extending generally upwardly from said track top panel and spaced apart a distance corresponding to the width of said decking member, each of said receiving tangs capable of engaging one of said decking member longitudinal side edge slots, and (c) a plurality of spaced-apart pairs of fastening tangs integral with and extending generally upwardly from said track top panel, each of said pairs of fastening tangs adjoining a receiving tang and oriented at an open angle prior to engaging said other of said decking longitudinal side edge slots, the installation tool comprising a base having a distal portion and a proximal portion, said base distal portion comprising:

(a) a bottom face having a pair of oppositely disposed side rails projecting downwardly such that a channel is formed therebetween and configured to slidably straddle said track top panel;

(b) a generally planar top face having a hole formed therein for receiving and securing a manipulating rod therein;

(c) a generally planar rear face interconnecting said top and bottom faces of said base distal portion, said rear face angled such that said rear face bottom edge extends distally farther than said rear face top edge, whereby said rear face presents a surface for conveniently receiving an impact force from a hammering device;

(d) a front face;

said base proximal portion extending laterally from a bottom region of said front face, said base proximal portion comprising:

(e) a bottom face having a pair of oppositely disposed side rails projecting downwardly such that a channel is formed therebetween and configured to slidably straddle said track top panel;

(f) a generally planar top face disposed at a distance from said base proximal portion bottom face less than the distance of said base distal portion top face from said base distal portion bottom face;

(g) a front surface alignable with said fastening tangs and having a gap formed therein with a width such said adjoining receiving tang is receivable within said gap and contact between said base proximal portion and said receiving tang is avoided;

whereby imparting a striking force to said rear face urges said front surface laterally into contact with said fastening tang, thereby engaging said fastening tangs within said other of said decking member longitudinal side edge slots to secure said decking member to said track.

12. The installation tool of claim 11, wherein each of said pairs of fastening tangs has a receiving tang interposed therebetween and wherein said base proximal portion front surface comprises a pair of front surface portions alignable with said pair of fastening tangs and having said gap formed therebetween.

13. The installation tool of claim 11, wherein said base distal portion top face hole is threaded and said manipulating rod has corresponding threads formed on an end thereof, said manipulating rod threaded end receivable and securable within said base distal portion top face threaded hole.

14. The installation tool of claim 11, further comprising a striker insert, and wherein said base distal portion rear face has a hole formed therein for receiving and securing said striker insert therein.

15. The installation tool of claim 14, wherein said base distal portion rear face hole is threaded and said striker insert comprises a shaft extending therefrom having corresponding threads formed thereon, said striker insert shaft receivable and securable within said base distal portion rear face threaded hole.

16. The installation tool of claim 14, wherein said striker insert is a resilient pad capable of cushioning said striking force when imparted by a manually operated hammer.

17. The installation tool of claim 14, wherein said striker insert is a rigid plate capable of absorbing said striker force when imparted by a pneumatically operated hammer.

18. The installation tool of claim 11, wherein said base is milled from a single block of rigid material, whereby said base proximal portion is formed integrally with said base distal portion.

19. The installation tool of claim 11, wherein said base is molded from impact resistant thermoplastic material.

20. The installation tool of claim 19, wherein said front surface has a pair of reinforcement insert embedded within said front surface, whereby said thermoplastic material is protected from direct contact with said fastening tangs.

* * * * *